US007523725B2

(12) United States Patent
Mann

(10) Patent No.: US 7,523,725 B2
(45) Date of Patent: Apr. 28, 2009

(54) METHOD FOR CONTROLLING AND/OR REGULATING A COOLING SYSTEM OF A MOTOR VEHICLE

(75) Inventor: Karsten Mann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 548 days.

(21) Appl. No.: 10/511,289

(22) PCT Filed: Apr. 11, 2003

(86) PCT No.: PCT/DE03/01227

§ 371 (c)(1),
(2), (4) Date: Jul. 6, 2005

(87) PCT Pub. No.: WO03/087551

PCT Pub. Date: Oct. 23, 2003

(65) Prior Publication Data

US 2005/0257755 A1 Nov. 24, 2005

(30) Foreign Application Priority Data

Apr. 15, 2002 (DE) ..... 102 16 720
Apr. 10, 2003 (DE) ..... 103 16 753

(51) Int. Cl.
*F01P 7/00* (2006.01)
*F01P 7/14* (2006.01)

(52) U.S. Cl. ..... 123/41.02; 123/41.1

(58) Field of Classification Search ..... 123/41.01, 123/41.02, 41.1

See application file for complete search history.

(56) References Cited

U.S. PATENT DOCUMENTS 5,529,025 A 6/1996 Ranzinger et al.
6,216,475 B1 4/2001 Sada et al.

FOREIGN PATENT DOCUMENTS

| | | | |
|---|---|---|---|
| DE | 2656361 A | * | 6/1978 |
| DE | 35 16 502 | | 11/1986 |
| DE | 197 28 351 | | 1/1999 |
| DE | 199 39 138 | | 2/2001 |
| DE | 199 51 362 | | 5/2001 |
| DE | 100 35 770 | | 1/2002 |
| DE | 101 53 943 | | 5/2003 |
| DE | 101 63 944 | | 7/2003 |
| EP | 894954 A1 | * | 2/1999 |
| EP | 0 965 737 | | 12/1999 |
| JP | 60049850 A | * | 3/1985 |
| JP | 08303291 A | * | 11/1996 |

OTHER PUBLICATIONS

Engine Engineering Journal MTZ 62 (2001) 1, pp. 30 to 35, "A cylinder sealing concept for future internal combustion engine generations."

* cited by examiner

*Primary Examiner*—Noah Kamen
(74) *Attorney, Agent, or Firm*—Kenyon & Kenyon LLP

(57) ABSTRACT

The present invention provides a method for controlling and/or regulating a cooling system, a desired coolant temperature being determined from a desired component temperature in a desired coolant temperature determination. Energy consumption of a driving engine and a coolant flow may be taken into consideration in the determination of the desired coolant temperature.

8 Claims, 1 Drawing Sheet

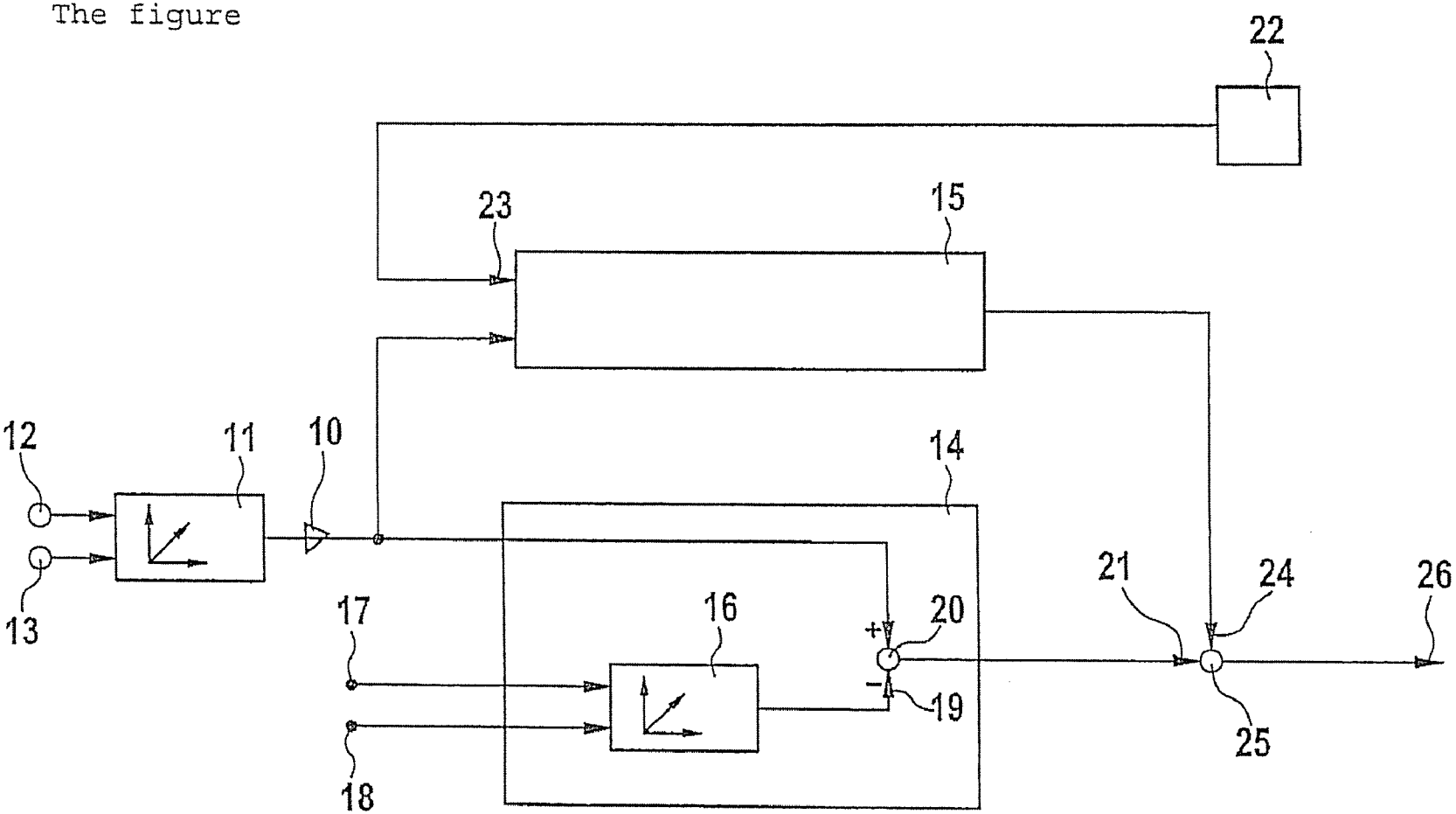
The figure

METHOD FOR CONTROLLING AND/OR REGULATING A COOLING SYSTEM OF A MOTOR VEHICLE

FIELD OF THE INVENTION

The present invention relates to a method for controlling and/or regulating a cooling system of a motor vehicle.

BACKGROUND INFORMATION

A cooling system contains a heat source to be cooled, for example a driving engine of a motor vehicle, that is cooled by a coolant via free or forced convections. The temperature difference from the heat source depends on the heat input and the coolant flow, while the temperature of the coolant is determined from the heat input of the heat source, the heat derivation via the cooler located in the circulation, and the heat capacities of the materials. Vehicle development focuses, for example, on need-based control or regulation of the cooling system with the objective of reducing energy consumption, decreasing potentially occurring emissions or maintaining emission limit values, and also increasing the comfort level. In this context, critical thermal loading limits of components may not be exceeded. A critical temperature is for example the temperature of the cylinder head of an internal combustion engine used as a driving engine.

Temperature sensors that record the temperatures of components of an internal combustion engine or other components to be cooled are described, for example, in the engine engineering journal MTZ 62 (2001) 1, pages 30 to 35, "A cylinder sealing concept for future internal combustion engine generations." The temperature sensors may situated in the cylinder head gasket.

A method for the optimal control of the cooling performance of an internal combustion engine of a motor vehicle is further described in from German Published Patent Application No. 100 35 770.

A regulating structure or a regulating strategy for controlling the cooling system of a motor vehicle based on a desired coolant temperature is described, for example, in the two German Patent Application Nos. 101 63 944.9 and 101 53 943.0.

SUMMARY OF THE INVENTION

The method of the present invention for controlling and/or regulating a cooling system provides for a desired coolant temperature to be determined as a function of at least one desired component temperature.

The desired coolant temperature relates in this context to a certain location in the cooling system. Provided that the cooling system includes a driving engine, in particular an internal combustion engine, such a specific location is, for example, the inlet of the coolant into the driving engine or the outlet of the coolant.

The desired component temperature may be the temperature of a component of the driving engine or the desired temperature of another component integrated in the cooling system. Such a component may be, for example, an electric motor, a generator, or an electronic module cooled by the coolant. However, the desired component temperature may also be a predefined desired coolant temperature at a predefined location.

The desired component temperature may be defined in a fixed manner or as a function of parameters, for example.

The relationship between the desired component temperature and the desired coolant temperature determined therefrom may be provided for example in a fixed manner on the basis of a determined physical relationship or in a variable manner as a function of parameters. Instead of the physical relationship, an experimentally determined relationship may also be used as a basis. The relationship must ensure that the determined desired component temperature is maintained and not exceeded via the determined desired coolant temperature.

The cooling system of the motor vehicle may be controlled and/or regulated using the determined desired coolant temperature or a quantity representing the desired coolant temperature. Reference is made in this connection to the already cited, German Patent Application Nos. 101 63 944.9 and 101 53 943.0.

A method according to the present invention allows the thermal loading limit of the component to be closely approached. This may result in advantages for the energy consumption of a driving engine, in particular of an internal combustion engine. Other savings may be achieved from the need-compliant design of the cooling system as well as of the components to be cooled.

A process control according to a method of the present invention may be accommodated for example in a control unit (not shown more closely) of a driving engine so that there are no additional costs for electronic components.

An embodiment of the method of the present invention provides for a calculated temperature difference to be used to determine the desired coolant temperature from the desired component temperature, the temperature difference being subtracted from the desired component temperature. The temperature difference is to be defined such that the desired component temperature is maintained and also possibly not exceeded via the resulting desired coolant temperature.

The temperature difference is first dependent on the heat input into the cooling system that is influenced for example by the energy consumption of a driving engine contained in the cooling system. Therefore, an embodiment of the method of the present invention provides for the energy consumption of the driving engine to be taken into consideration in the determination of the temperature difference.

The temperature difference is also dependent on the heat transfer between the coolant and the surroundings, the heat transfer being particularly dependent on the coolant flow. Therefore, an advantageous example embodiment of the method of the present invention provides for the coolant flow to be taken into consideration in the determination of the temperature difference.

A further example embodiment that may be provided in the use of an internal combustion engine as a driving engine provides for the heat input from the fuel consumption of the internal combustion engine to be determined by being multiplied by a factor. The factor depends on the energy content of the fuel as well as from the efficiency of the internal combustion engine in the presently available working point. The factor may be stored in a family of characteristics. The factor is a constant value in a simpler embodiment. In this context, the constant value is advantageously determined at least as a function of the fuel type used. As a result, the method of the present invention may be used in a particularly advantageous manner for a gasoline internal combustion engine as well as for a diesel internal combustion engine. An embodiment provides for the temperature difference to be determined from a family of characteristics in which the energy consumption or fuel consumption and the coolant flow are provided as input quantities.

A further example embodiment of the method of the present invention provides for the desired component temperature to be dependent on the presently available operating point of a driving engine integrated in the cooling system. The dependence may be stored in a family of characteristics.

A further example embodiment of the method of the present invention provides for the determined desired coolant temperature to be corrected as necessary by a correction temperature that is determined by a regulator from the desired component temperature and a measured actual component temperature.

BRIEF DESCRIPTION OF THE DRAWING

The FIGURE shows functional blocks for determining a desired coolant temperature from a desired component temperature.

DETAILED DESCRIPTION

FIG. 1 shows a desired component temperature 10, which is provided by a first family of characteristics 11. First family of characteristics 11 determines desired component temperature 10 from a speed 12 and a torque 13 of a driving engine not shown more closely. Desired component temperature 10 is supplied to a desired coolant temperature determination 14 and a regulator 15.

Desired coolant temperature determination 14 includes a second family of characteristics 16, which outputs a calculated temperature difference 19 as a function of a coolant flow 17 and energy consumption 18. Desired coolant temperature determination 14 also includes a first adder 20, which determines a desired coolant temperature 21 from temperature difference 19 and desired component temperature 10.

Regulator 15 uses a desired component temperature 10 and a measured actual component temperature 23 provided by a temperature sensor 22 to determine a correction temperature 24, which is supplied to a second adder 25, which provides a corrected desired coolant temperature 26 from correction temperature 24 and desired coolant temperature 21.

An embodiment of the method of the present invention proceeds as follows:

Desired component temperature 10 corresponds for example with a maximum allowable temperature of a component to be cooled that is integrated in a cooling system, for example, a driving engine component. Such a component is for example a cylinder head gasket of an internal combustion engine. Components situated outside of the driving engine may also be provided as components to be cooled. Such components may be electric motors, generators, or also electronic modules to be cooled. The coolant itself may also be provided as a component to have a certain desired component temperature 10 at a predefined location in the cooling system. Desired component temperature 10 may be defined in a fixed manner, for example. Alternatively, desired component temperature 10 may also be dependent on parameters described further below.

Desired coolant temperature determination 14 is responsible for determining desired coolant temperature 21 from desired component temperature 10.

The functional relationship between desired component temperature 10 and desired coolant temperature 21 may be specified in a fixed manner in a simple embodiment. For example, it may be provided for a fixedly specified temperature difference between the two temperatures to be defined such that the setting actual component temperature maintains and does not exceed the maximum allowable component temperature. The relationship may be calculated on the basis of physical relationships or be experimentally determined. The simple embodiment may be used in particular for a cooling system operated in a largely stationary manner in which the heat flows change only minimally with the exception of a warm-up. Desired component temperature 10 is specified as 110° C., for example. Desired coolant temperature 21 is then set to be 90° C., for example.

In general, a relationship between a component temperature and the coolant temperature may be derived in the following manner. The simplification is conducted in the following so that static relationships are considered. A general equation representing the quotients from the temperature change and time change is used as a basis. In this context, the time-related component temperature change (dT/dt) equals the quotient from the sum of the heat flows (Σ Qs), which are supplied to or removed from the component, and the product of mass (m) and specific heat capacity (cp).

$$dT/dt=\Sigma Qs/(m*cp).$$

The actual component temperature remains constant when the sum of the heat flows is exactly equal to zero. Using the known equations for the heat transfer between component and coolant, this condition, solved for the coolant temperature, yields a relationship between component and coolant temperature for the stationary case. In general, the coolant temperature is a function of the introduced heat quantity (waste heat or power loss of the component), coolant flow 17, and actual component temperature 23. For simplification, the basic heat transfer equation is taken as a basis by convention to determine desired coolant temperature 21. This basic equation is as follows:

$$Qs=\text{alpha}*A*(\text{desired coolant temperature 21}-\text{desired component temperature 10})$$

The component temperature then corresponds with desired component temperature 10. The heat transfer coefficient alpha is assumed to be constant for the sake of simplification. Its volume flow dependence, for example, is neglected in this context. Heat-transferring surface A may be estimated. Solving for the coolant temperature results in the following relationship:

$$\text{Desired coolant temperature 21}=\text{desired component temperature 10}-Qs/(\text{alpha}*A)$$

Provided that a driving engine is provided as the heat source, the heat input depends on the energy consumption of the driving engine. Desired coolant temperature 21 may then be determined from desired component temperature 10 under consideration of energy consumption 18 of the driving engine.

Provided that the driving engine is an internal combustion engine, the energy consumption results directly from the fuel consumption. A corresponding fuel consumption signal is generally available in the engine control.

Different fuel types may be taken into consideration by different constants.

The heat balance at the component to be cooled is not only dependent on the already considered heat flows but also on coolant flow 17. Therefore, the functional relationship between desired component temperature 10 and desired coolant temperature 21 is formed as a function of coolant flow 17 in an advantageous embodiment. A further refinement of this embodiment provides for coolant flow 17 to be taken into consideration in the provision of temperature difference 19. The relationship is advantageously stored in second family of characteristics 16, to which coolant flow 17 is supplied as an input signal.

According to a further embodiment, a second family of characteristics 16 represents the temperature difference 19 as a function of energy consumption 18 as well as coolant flow 17. For a specified desired component temperature 10 of 110° C., for example, temperature difference 19 is output from second family of characteristics 16 as 20° C., for example. An increase in energy consumption 18 results in an increase in temperature difference 19 to 30° C., for example, while an increase in coolant flow 17 results in a decrease in temperature difference 19 to 10° C., for example.

Another embodiment relates to the provision of desired component temperature 10, which may be determined as a function of a working point of an existing driving engine. Provided that the driving engine is an internal combustion engine, the working point may be represented for example by speed 12 and/or torque 13 of the internal combustion engine.

In the depicted exemplary embodiment, speed 12 and torque 13 are supplied to first family of characteristics 11, which outputs desired component temperature 12.

An advantageous further refinement provides for the use of regulator 15. Regulator 15 uses desired component temperature 10 and actual component temperature 23 to determine correction temperature 24, via which desired coolant temperature 21 is corrected in second adder 25 to form corrected desired coolant temperature 26. Actual component temperature 23 is provided by temperature sensor 22, which measures the temperature of the component. Regulator 15 includes at least one component that ensures stationary accuracy. Regulator 15 first corrects a stationary error underlying the functional relationship between desired component temperature 10 and desired coolant temperature 21 in desired coolant temperature determination 14. The deviation may be caused, for example, by potentially available second family of characteristics 16, which outputs temperature difference 19. In the case of non-stationary conditions, regulator 15 also supports the downstream control or regulation of the coolant temperature to which corrected desired coolant temperature 26 is supplied. The upstream regulation supports the downstream regulation, thereby increasing the overall regulating speed and accuracy.

What is claimed is:

1. Method, comprising:

determining a desired coolant temperature at least as a function of a desired component temperature; and providing a family of characteristics;

wherein a temperature difference is:

derived from the family of characteristics, a coolant flow, and an energy consumption; and subtracted from the desired component temperature in order to obtain the desired coolant temperature.

2. The method of claim 1, wherein the desired component temperature depends on an operating point of the driving engine contained in the cooling system.

3. The method of claim 2, wherein the desired component temperature depends on at least one of a speed and a torque of the driving engine.

4. Method, comprising:

determining a desired coolant temperature at least as a function of a desired component temperature; and providing a regulator to determine a correction temperature which is used to correct the desired coolant temperature, the correction temperature being determined from the desired component temperature and an actual component temperature measured by a temperature sensor.

5. A method for controlling a cooling system, comprising:

determining a desired coolant temperature at least as a function of a desired component temperature;

wherein a coolant flow is taken into consideration in determining the desired coolant temperature.

6. A method for controlling a cooling system, comprising:

determining a desired coolant temperature at least as a function of a desired component temperature;

wherein a heat input of a driving engine included in the cooling system is taken into consideration in determining the desired coolant temperature.

7. The method of claim 6, wherein a temperature difference is subtracted from the desired component temperature in order to obtain the desired coolant temperature.

8. The method of claim 6, wherein an energy consumption of the driving engine is taken into consideration in determining the desired coolant temperature.

* * * * *